US006931799B2

(12) United States Patent
Webb

(10) Patent No.: US 6,931,799 B2
(45) Date of Patent: Aug. 23, 2005

(54) ANCHORING PROFILE, A FRAME ASSEMBLY AND A METHOD FOR SECURING A PANE AGAINST

(76) Inventor: Martin Webb, c/o FrameGard Anchoring Systems Limited, 15 Duncan Close, Moulton Park, Northamptonshire (GB), NN3 6WL ( * ) Notice: Subject to any disclaimer, the term of this patent is extended or adjusted under 35 U.S.C. 154(b) by 91 days.

(21) Appl. No.: 10/297,834

(22) PCT Filed: Mar. 19, 2002

(86) PCT No.: PCT/GB02/01247

§ 371 (c)(1),
(2), (4) Date: Jun. 2, 2003

(87) PCT Pub. No.: WO02/088504

PCT Pub. Date: Nov. 7, 2002

(65) Prior Publication Data

US 2004/0020143 A1 Feb. 5, 2004

(30) Foreign Application Priority Data

Apr. 25, 2001 (GB) ..... 01101641

(51) Int. Cl.[7] ..... E04B 1/98; E04B 3/96

(52) U.S. Cl. ..... 52/167.1; 52/202; 52/204.62; 156/71; 248/208

(58) Field of Search ..... 52/167.1, 204.53, 52/204.62, 202, 203; 156/71; 248/208, 220.1

(56) References Cited

U.S. PATENT DOCUMENTS

| | | | | | |
|---|---|---|---|---|---|
| 2,046,362 | A | * | 7/1936 | Baldwin | 52/203 |
| 2,862,264 | A | * | 12/1958 | Perna | 52/287.1 |
| 4,052,830 | A | | 10/1977 | Smith | |
| 4,075,802 | A | | 2/1978 | Gross et al. | |
| 4,184,297 | A | | 1/1980 | Casamayor | |
| 4,313,991 | A | * | 2/1982 | Lamb | 428/131 |
| 4,932,183 | A | * | 6/1990 | Coulston | 52/417 |
| 5,313,755 | A | * | 5/1994 | Koenig, Jr. | 52/255 |
| 5,426,897 | A | | 6/1995 | Gazaway | |
| 5,477,643 | A | * | 12/1995 | Koenig, Jr. | 52/100 |
| 5,553,422 | A | * | 9/1996 | Gazaway | 52/204.53 |
| 5,992,107 | A | * | 11/1999 | Poirier | 52/203 |
| 6,044,601 | A | * | 4/2000 | Chmela et al. | 52/287.1 |
| 6,308,472 | B1 | * | 10/2001 | Coulton et al. | 52/198 |
| 6,367,210 | B1 | * | 4/2002 | Trundle | 52/204.5 |
| 6,530,184 | B1 | * | 3/2003 | Emek | 52/204.591 |
| 6,627,017 | B2 | * | 9/2003 | Simpson | 156/71 |
| 6,679,013 | B2 | * | 1/2004 | Hornung | 52/204.62 |

FOREIGN PATENT DOCUMENTS

| | | |
|---|---|---|
| FR | 2457956 | 12/1980 |
| GB | 2184475 | 6/1987 |
| GB | 2327700 | 2/1999 |
| WO | WO9859143 | 12/1998 |

OTHER PUBLICATIONS

International Search Report dated Jul. 2, 2002 (2 pages).
Search Report under Section 17 dated Aug. 16, 2001 (1 page).

* cited by examiner

*Primary Examiner*—Brian E. Glessner
(74) *Attorney, Agent, or Firm*—Baker & Hostetler LLP

(57) ABSTRACT

An anchoring profile (1) for securing a pane (9) mounted in a frame (8) and protected against impact by window film (11). For ease of installation and to reduce costs, the profile (1) comprises two outer strips of substantially rigid plastics material (2,3) for attachment by adhesive (6) to the window film (11) and he frame (8), respectively, and a flexible interconnecting strip (4) between the outer strips (2,3) having sufficient resilience to absorb, in use, impact load in the pane (9).

13 Claims, 2 Drawing Sheets

ANCHORING PROFILE, A FRAME ASSEMBLY AND A METHOD FOR SECURING A PANE AGAINST

An anchoring profile, a frame assembly and a method for securing pane against impact.

FIELD OF THE INVENTION

The present invention relates to an anchoring profile, a frame assembly and a method for securing a pane against impact.

BACKGROUND OF THE INVENTION

It is known to apply window safety film (hereinafter referred to as "window film") to the inside face of window and door panes to prevent glass shattering. Such window film consists of a layer or layers of thin polyester adhesive film, which is applied to the inside surface of the glass (or transparent plastics sheet) to improve impact resistance, and also to hold loose shards of glass together when the glass is broken by an impact.

Such window films will reduce bomb blast injuries, since the film holds the loose shards together and the whole window pane will drop to the ground as one piece rather than hundreds of cutting shards. Similarly, such films are extensively used in schools and hospitals to resist falling body impact, eg where persons trip and fall against non safety-rated glass. The glass shatters, but it does not disintegrate into multiple shards, because the window film holds the shards together.

Thicker and stronger films are used to improve smash and grab resistance of retail shop windows. However, it is possible to gain entry by using a lever bar to prise the glass and film away from the edge of the frame, thus creating a hole to allow entry therethrough, eg smash and grab or forced entry.

When window film is fitted to the inside face of the glass of a window or door, a gap is usually left around the edge of the pane (normally referred to as a "daylight" gap) where the film is trimmed against the frame. This means that the glass and window film can drop out of the window or door frame if enough force is applied. After bomb blasts it is common to see complete glass sheets with film lying inside a building.

It is known to apply the film to the pane so that it overlaps the surrounding frame and to use a beading or profile to clamp the overlapping film to the surrounding frame. Although this does increase the security of the pane against impact considerably, there is a tendency for the film to stretch and tear along the edge of the profile during an impact. Furthermore, where the profile has a gasket engaging the film on the pane, there is also a tendency for the gasket to be pulled out by the film as it stretches during an impact This problem is overcome by GB 2 327 700 B, which discloses a clamping profile comprising a first elongate side portion attachable by fixing means (eg screws) therethrough to the surrounding frame to clamp the overlapping film, and a second elongate side portion having a gasket protruding therefrom for cushioning impact movement of the pane and film. The first and second elongate side portions are substantially at right angles to each other and are connected by an elongate curved portion of the profile to minimise the risk of tearing of the film during an impact on the pane. The outer surface of the curved portion of the profile has a radius of curvature from 4 mm to 15 mm.

Although this clamping profile has proved successful in use, it is costly to manufacture and time consuming, and hence costly, to install. Furthermore, the window film must be wrapped around the frame, which also adds to the cost of installation.

SUMMARY OF THE INVENTION

An object of the present invention is to provide an anchoring profile, which is relatively cheap to manufacture and is also simple to install.

The present invention provides an anchoring profile

The invention also provides a frame assembly

The invention also provides a method for securing a pane mounted in a frame against impact.

BRIEF DESCRIPTION OF THE DRAWINGS

Embodiments of the invention will now be described by way of example with reference to the accompanying drawings, wherein.

DESCRIPTION OF THE PREFERRED EMBODIMENT

Figure 1:
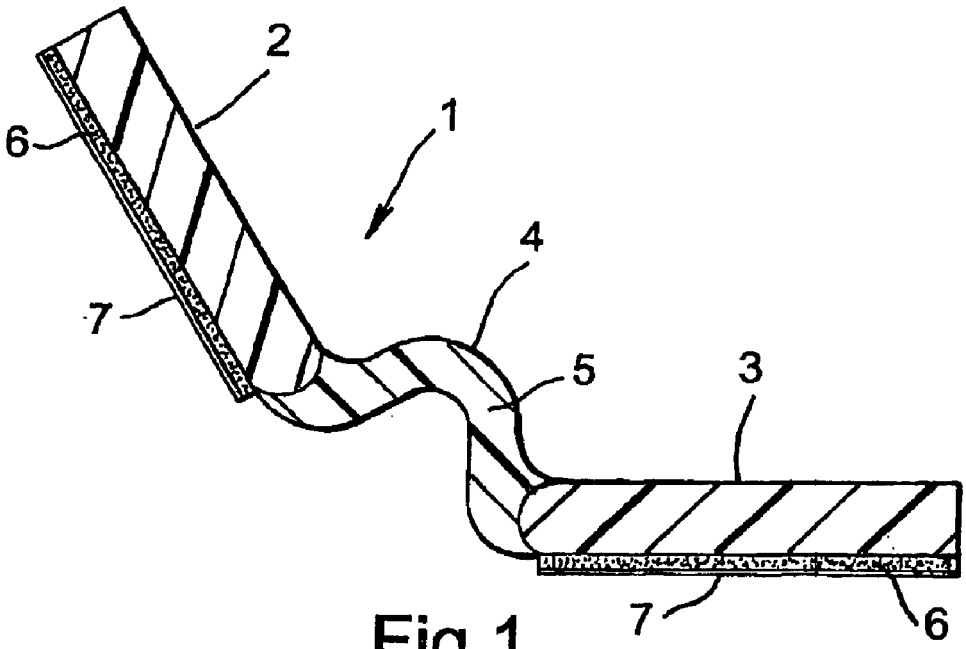
FIG. 1 is a cross-sectional view of an anchoring profile in accordance with the invention.

In FIG. 1, an anchoring profile 1 has two outer strips 2, 3 of substantially rigid plastics material, and a flexible interconnecting strip 4 having a corrugation 5. The surfaces of the outer strips 2, 3 facing away from the corrugation 5 are coated with adhesive material 6, preferably covered with a removable tape 7.

Figure 2:
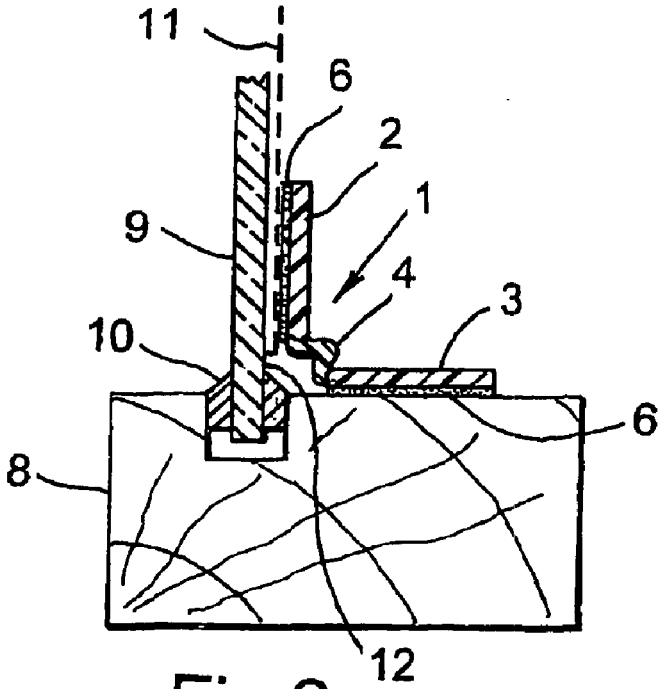
FIG. 2 is a cross-sectional view through part of a window frame secured by the anchoring profile of FIG. 1.

In FIG. 2, the anchoring profile 1 is shown fitted in place. A window (or door) frame 8 carrying a pane 9 of glass (or plastics material) is fitted within the frame 8 via gaskets 10. Window film 11 has been applied to the pane 9 to leave the usual "daylight" gap 12 around the periphery of the film 11.

The anchoring profile 1 is installed merely by removing the tape 7 and urging the strips 2 and 3 up against the pane 9 carrying the film 11 and the frame 8, respectively. The strips 2 and 3 should be pressed hard against the pane 9 and the frame 8, respectively, so as to ensure good adhesion. No screws are required to attach the strip 3 to the frame 8. Nor is it necessary for the window film 2 to be fitted to extend beyond the pane 9 to between the strip 3 and the frame 8.

Preferably, the outer strips 2 and 3 and the interconnecting strip 4 of the anchoring profile 1 are formed of PVC, preferably by simultaneous extrusion.

The outer strips preferably have a modulus of elasticity of 2,100–2,500 MPa, and a tensile strength 35–50 MPa Preferably, the outer strips 2, 3 also have an elongation at break of 130–170% and a Charpy impact strength ("V" Notch) of 7.5–8.5 kJ/sqm.

A suitable material for the substantially rigid outer strips 2, 3 is "RE 244" manufactured by "Vitapol", a division of Vita Thermoplastic Compounds Limited of Middleton, Manchester.

Preferably, the interconnecting strip 4 has a Shore A hardness of 48°–63° and a tensile strength of 9–11.5 MPa. Preferably, the elongation at break is 350–500%, and the British Standard Softness is 75°–95°.

A suitable material for the flexible interconnecting strip is "WP559BR40" manufactured by the Berwin Polymer Processing Group of Dukinfield, Cheshire.

The adhesive 6 is any suitable "aggressive" adhesive, eg as used in auto trim attachment or skin to frame assembly, or where adhesive is used as a replacement of mechanical fasteners and welts. A suitable material is the "5300" acrylic double-sided tape from Davis Industrial Supplies of Letchworth, Hertfordshire having a tensile strength, cleavage peel strength and dynamic sheer strength of 140, 21 and 63 $Ncm^{-2}$ respectively, a peel adhesion of 110N/25 mm and an elongation of 500%. The tape on one side is removed before applying the adhesive 6 and with the tape on the other side, ie the removable tape 7 to the outer strips 2 and 3.

Figure 3:
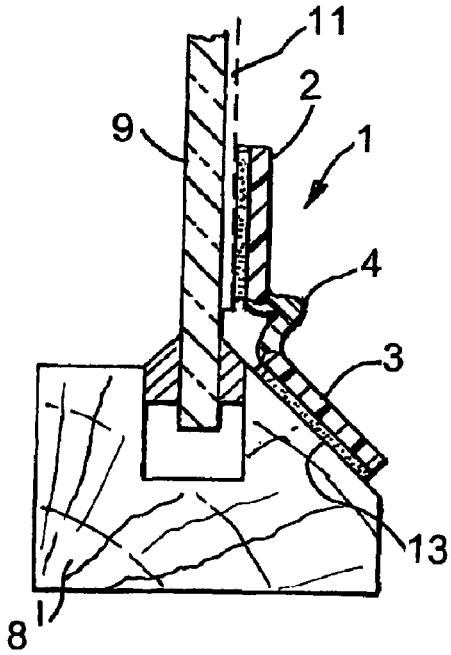
FIG. 3 shows a similar view to FIG. 2 with the inside surface of the window frame inclined downwardly, FIG. 4. is a similar view to FIG. 3 with the inside surface of the window frame curved downwardly, FIG. 5. is an enlarged cross-sectional view of the anchoring profile of FIG. 4.

In FIG. 3, the inside surface 13 of the frame $\mathbf{8}^{1}$ slopes sharply downwards, but the flexible strip 4 allows the same anchoring profile 1 of FIG. 2 to be used.

Figure 4:
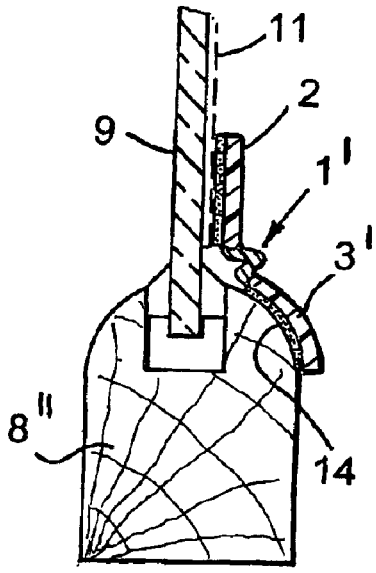
Figure 5:
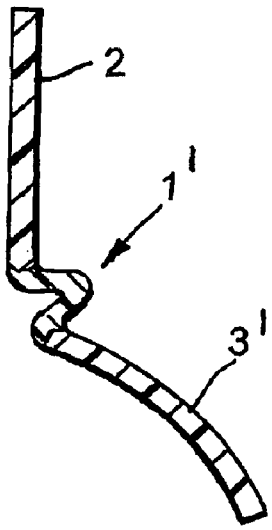

In FIG. 4, the window frame $\mathbf{8}^{11}$ has a curved inside surface 14, and the outer strip $\mathbf{3}^{1}$ has a similarly shaped profile. The anchoring profile $\mathbf{1}^{1}$ is fitted to the pane 9 and frame $\mathbf{8}^{11}$ in a similar way to that of the embodiment of FIG. 2. The anchoring profile $\mathbf{1}^{1}$ is shown enlarged in FIG. 5.

Figure 6:
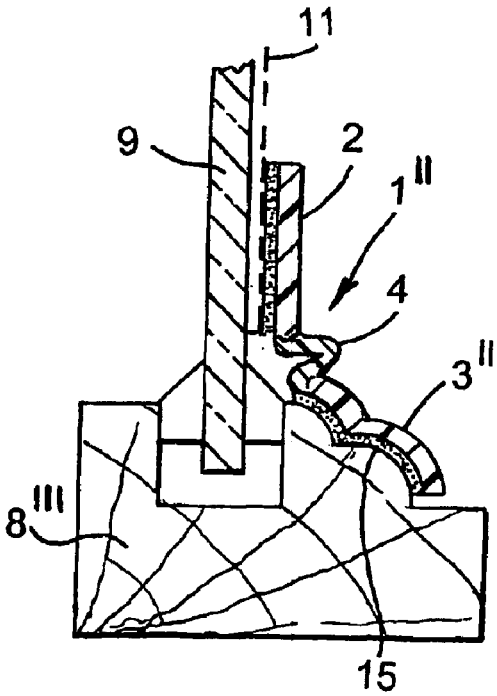
FIG. 6 is a view similar to FIG. 4 in which the inside surface of the window frame has a stepped curved profile.

In FIG. 6, the anchoring profile $\mathbf{1}^{11}$ is fitted to a frame $\mathbf{8}^{111}$ having an inside surface 15 with stepped curves, and the strip $\mathbf{3}^{11}$ is shaped accordingly during manufacture of the anchoring profile $\mathbf{1}^{11}$ so as to fit snugly on the frame $\mathbf{8}^{111}$.

Clearly, the anchoring profile 1 of FIGS. 1, 2 and 3 may be used for any frame having a flat inside surface. For frames having a non-flat inside surface the anchoring profile may be provided with a correspondingly shaped outer strip 3.

Not only are the anchoring profiles described above relatively cheap to manufacture, they are simple and quick to install. Furthermore, the separate gasket of GB 2 327 700 B is no longer required.

What is claimed is:

1. A frame assembly comprising:

a frame;

a pane mounted in the frame and protected by window film; and an anchoring profile for securing a pane mounted in a frame and protected against impact by window film, the profile comprising two outer strips of substantially rigid plastics material for attachment by adhesive to the window film and the frame, respectively, and a flexible interconnecting strip between the outer strips having sufficient resilience to absorb, in use, impact load on the pane and, wherein the outer strips of the anchoring profile are attached by adhesive to the window film and the frame, respectively.

2. A frame assembly as claimed in claim 1, wherein the flexible strip has a corrugation directed, in use, away from the junction between the pane and the frame.

3. A frame assembly as claimed in claim 1, wherein the outer strips and the interconnecting strip are formed by simultaneous extrusion.

4. A frame assembly as claimed in claim 1, wherein the outer strips and the interconnecting strip are formed of PVC.

5. A frame assembly as claimed in claim 1, wherein the outer strips have a modulus of elasticity of 2100–2500 MPa and a tensile strength of 35–50 MPa.

6. A frame assembly as claimed in claim 1, wherein the interconnecting strip has a Shore A hardness of 48°–63° and a tensile strength of 9–11.5 MPa.

7. A frame assembly as claimed in claim 1, wherein the sides of the outer strips facing, in use, the pane and the frame, respectively, carry adhesive covered by a removable tape.

8. A frame assembly as claimed in claim 7, wherein the adhesive is an acrylic adhesive and the removable tape is a siliconised release liner.

9. A frame assembly as claimed in claim 1, wherein the outer strip for attachment to the frame has a non-flat surface to fit against a corresponding non-flat surface of the frame.

10. A frame assembly as claimed in claim 1, wherein there is a peripheral clearance gap between the edge of the window film and the frame.

11. A method of securing a pane mounted in a frame assembly against impact, the frame assembly comprising;

a frame;

a pane mounted in the frame and protected by window film; and an anchoring profile for securing a pane mounted in a frame and protected against impact by window film, the profile comprising two outer strips of substantially rigid plastics material for attachment by adhesive to the window film and the frame, respectively, and a flexible interconnecting strip between the outer strips having sufficient resilience to absorb, in use, impact load on the pane and, wherein the outer strips of the anchoring profile are attached by adhesive to the window film and the frame, respectively; the method comprising applying a window film to the pane, attaching the outer strips of the anchoring profile to the window film and the frame, respectively, by adhesive.

12. A method as claimed in claim 11, wherein the window film is applied to the pane with a clearance gap therearound.

13. A method as claimed in claim 11, wherein the outer strips and the interconnecting strip are formed by simultaneous extrusion.

* * * * *

UNITED STATES PATENT AND TRADEMARK OFFICE

CERTIFICATE OF CORRECTION

PATENT NO. : 6,931,799 B2
DATED : August 23, 2005
INVENTOR(S) : Martin Webb

It is certified that error appears in the above-identified patent and that said Letters Patent is hereby corrected as shown below:

Title page, Item [54] and Column 1, line 1,
Title, replace with -- AN ANCHORING PROFILE, A FRAME ASSEMBLY AND A METHOD FOR SECURING A PANE AGAINST IMPACT --.

Signed and Sealed this

Third Day of January, 2006

JON W. DUDAS
*Director of the United States Patent and Trademark Office*